US011963656B2

(12) United States Patent
Lee et al.

(10) Patent No.: US 11,963,656 B2
(45) Date of Patent: Apr. 23, 2024

(54) CLEANER

(71) Applicant: LG Electronics Inc., Seoul (KR)

(72) Inventors: Dongjae Lee, Seoul (KR); Jungwan Ryu, Seoul (KR); Daeho Chang, Seoul (KR); Jaesung Yang, Seoul (KR)

(73) Assignee: LG Electronics Inc., Seoul (KR)

( * ) Notice: Subject to any disclaimer, the term of this patent is extended or adjusted under 35 U.S.C. 154(b) by 133 days.

(21) Appl. No.: 17/167,311

(22) Filed: Feb. 4, 2021

(65) Prior Publication Data

US 2021/0235953 A1 Aug. 5, 2021

(30) Foreign Application Priority Data

Feb. 4, 2020 (KR) ..... 10-2020-0013375

(51) Int. Cl.
*A47L 9/28* (2006.01)
*A47L 5/24* (2006.01)
*A47L 9/16* (2006.01)

(52) U.S. Cl.
CPC ..... *A47L 9/2815* (2013.01); *A47L 5/24* (2013.01); *A47L 9/1641* (2013.01)

(58) Field of Classification Search
CPC ..... A47L 9/2815; A47L 5/24; A47L 9/1641; A47L 9/28; A47L 9/22; A47L 9/16
USPC ..... 15/339
See application file for complete search history.

(56) References Cited

U.S. PATENT DOCUMENTS 5,141,309 A 8/1992 Worwag
5,163,202 A 11/1992 Kawakami et al.
5,815,884 A 10/1998 Imamura et al.
2003/0146739 A1 8/2003 Bertram et al.
2007/0180648 A1 8/2007 Andrup et al.
2012/0030898 A1* 2/2012 Crouch ..... A47L 9/22 15/344
2018/0055323 A1* 3/2018 Hwang ..... A47L 5/24
2018/0317725 A1* 11/2018 Lee ..... A47L 9/2815
(Continued)

FOREIGN PATENT DOCUMENTS

CN 101036568 9/2007
CN 101273860 10/2008
(Continued)

OTHER PUBLICATIONS

Yun, Installation structure of dust sensor for upright vacuum cleaner, Oct. 5, 1999, English Translation of KR 19990037275 U (Year: 1999).*

(Continued)

*Primary Examiner* — Eric J Rosen
*Assistant Examiner* — Tyler James McFarland
(74) *Attorney, Agent, or Firm* — Fish & Richardson P.C.

(57) ABSTRACT

Provided is a cleaner including a dust separation unit separating dust in the air, a suction flow path supplying outside air to the dust separation unit, a fan module moving the air in the suction flow path, and a dust sensor measuring concentration of dust in the suction flow path. The suction flow path includes a first suction flow path extending in a first direction and a second suction flow path connecting the first suction flow path to the dust separation unit and extending in a second direction that forms an obtuse angle with the first direction, and the dust sensor is disposed in the second suction flow path.

19 Claims, 14 Drawing Sheets

(56) References Cited

U.S. PATENT DOCUMENTS

| | | | | |
|---|---|---|---|---|
| 2019/0267424 | A1* | 8/2019 | Koenig | H01L 27/14683 |
| 2019/0376907 | A1* | 12/2019 | Park | G01N 21/85 |

FOREIGN PATENT DOCUMENTS

| | | | |
|---|---|---|---|
| CN | 110099595 | | 8/2019 |
| DE | 102009005598 | | 9/2010 |
| DE | 102012100047 | | 7/2013 |
| EP | 1941822 | | 7/2008 |
| JP | 2007068684 | | 3/2007 |
| JP | 2012130377 | | 7/2012 |
| JP | 2019000477 | | 1/2019 |
| KR | 19990037275 | | 10/1999 |
| KR | 19990037275 | U * | 10/1999 |
| KR | 2019990037275 | | 10/1999 |
| KR | 1020060118047 | | 11/2006 |
| TW | 1656423 | | 8/2019 |
| TW | 201932061 | | 8/2019 |
| WO | WO2019164257 | | 8/2019 |

OTHER PUBLICATIONS

Extended European Search Report in European Appln. No. 21154900.1, dated Jun. 23, 2021, 5 pages.

Office Action in Australian Application No. 2021200720, dated Nov. 30, 2021, 6 pages.

Office Action in Chinese Appln. No. 202110154282.0, dated Jan. 21, 2022, 18 pages (with English translation).

Office Action in Taiwanese Appln. No. 110103708, dated Nov. 15, 2021, 20 pages (with English translation).

Office Action in Chinese Appln. No. 202110154282.0, dated Jul. 1, 2022, 14 pages (with English translation).

Extended European Search Report in European Appln. No. 22194380.6, dated Jan. 20, 2023, 7 pages.

* cited by examiner

CLEANER

CROSS-REFERENCE TO RELATED APPLICATIONS

This application claims priority to and the benefit of Korean Patent Application No. 10-2020-0013375, filed on Feb. 4, 2020. The disclosure of the prior application is incorporated by reference in its entirety.

BACKGROUND OF THE DISCLOSURE

Field of the Disclosure

The present disclosure relates to an arrangement of a dust sensor in a cleaner.

Related Art

Cleaners may be classified into a manual cleaner for cleaning while a user directly moves the cleaner, and a robot cleaner for cleaning while traveling by itself. In addition, the manual cleaner may be classified into a canister-type cleaner, an upright-type cleaner, a handy-type cleaner, a stick-type cleaner, or the like, depending on the shape of the cleaner.

The cleaner includes an impeller and a suction motor for rotating the impeller to provide the driving force to suck in dust.

In the related art, a dust sensor is mounted for measuring the concentration of dust in the air sucked into a suction part of the cleaner. The dust sensor in the related art is simply arranged in a straight pipe connected to a nozzle in structure.

According to the related art, since the dust sensor is mounted on a pipe far away from the main body, a structure for connecting power from the main body is required, resulting in problems such as a complicated structure, an increased manufacturing cost, inconvenient separation, and weakened reliability.

In addition, according to the related art, when the dust sensor is attached to a straight pipe having a fast air flow rate, there is a problem that the accuracy of the dust sensor deteriorates.

An example of the related art includes Korean Utility Model Publication. No. 1999-0037275.

SUMMARY

A first object of the present disclosure is to provide a cleaner with easy mounting and reduced cost when mounting a dust sensor on the cleaner.

A second object of the present disclosure is to provide a cleaner capable of improving the accuracy of concentration of dust measured by a dust sensor by mounting the dust sensor at a point where a flow rate decreases in a suction flow path of a cleaner.

A third object of the present disclosure is to provide a cleaner capable of easily connecting a power supply and a communication line, and reducing the length of an electric wire and the communication line or burying the electric wire and the communication line in a frame form in a main body, by disposing a dust sensor in a suction flow path adjacent to the main body.

A fourth object of the present disclosure is to provide a cleaner capable of measuring concentration of dust of the sucked air by a dust sensor near a main body of a cleaner, controlling a suction power of a suction motor by quickly reflecting the measured result, and displaying the concentration of dust.

A fifth object of the present disclosure is to provide a cleaner capable of reducing energy to be used and extending a battery usage time by adjusting an current amount of a suction motor depending on the concentration of dust in the sucked air.

In order to solve the above problems, the present disclosure is to provide a dust sensor disposed in a part of the main body where the direction of a suction pipe is changed.

In addition, the present disclosure is to provide a sensor cover that protects the dust sensor, and includes a window transmitting light of the dust sensor and an accommodation part preventing air and dust from leaking through a sensor hole.

In an aspect, a cleaner is provided. The cleaner includes a dust separation unit separating dust in the air, a suction flow path supplying outside air to the dust separation unit, a fan module moving the air in the suction flow path, and a dust sensor measuring concentration of dust in the suction flow path. The suction flow path includes a first suction flow path extending in a first direction and a second suction flow path connecting the first suction flow path to the dust separation unit and extending in a second direction that forms an obtuse angle with the first direction, and the dust sensor is disposed in the second suction flow path.

The cleaner according to the present disclosure may further include a flap door rotatably installed in the second suction flow path and opening and closing the suction flow path depending on pressure in the second suction flow path, and the dust sensor may be disposed closer to the first suction flow path than the flap door.

The dust sensor may include an emission unit emitting light, and a reception unit receiving the light emitted from the emission unit.

The dust sensor may further include a substrate on which the emission unit and the reception unit are disposed.

The emission unit and the reception unit may be disposed at positions facing each other in the second suction flow path.

The emission unit may be disposed on one side of a suction pipe defining the suction flow path, and the reception unit may be disposed to face the emission unit on the other end of the suction pipe.

The emission unit and the reception unit may be disposed to face the same direction in the second suction flow path.

The emission unit may be disposed on one side of a suction pipe defining the suction flow path, and the reception unit may be disposed adjacent to the emission unit on the one side of the suction pipe.

The emission unit and the reception unit may be disposed on one substrate.

The cleaner may further include a sensor cover covering the dust sensor.

The sensor cover may define a portion of a suction pipe defining the second suction flow path.

The dust sensor may include an emission unit emitting light and a reception unit receiving the light emitted from the emission unit, and the sensor cover may include an accommodation part accommodating at least one of the emission unit and the reception unit and having openings at both sides, and a window covering the opening of one side of the accommodation part and transmitting light.

The accommodation part may include an impermeable material.

The sensor cover may further include a cover support part connected to the accommodation part and extending outward of the accommodation part.

The cover support part may be coupled to a suction pipe defining the second suction flow path.

One surface of the cover support part may contact the suction pipe defining the second suction flow path.

The cleaner according to the present disclosure may further include a substrate on which at least one of the emission unit and the reception unit are disposed, and the other surface opposite to the one surface of the cover support part may contact one surface of the substrate.

The cleaner according to the present disclosure may further include a suction pipe defining the second suction flow path, in which a sensor hole where an accommodation part is positioned may be formed in the suction pipe.

An extension line in the first direction may meet the rotation axis of the fan module.

The fan module may include an impeller pressurizing air and a suction motor rotating the impeller.

BRIEF DESCRIPTION OF THE DRAWINGS

FIGS. 6A and 6B show different examples related to a location of a sensing unit 81, and FIGS. 6A and 6C show different examples related to presence or absence of a sound transmission tube 90.

DESCRIPTION OF EXEMPLARY EMBODIMENTS

Figure 1:
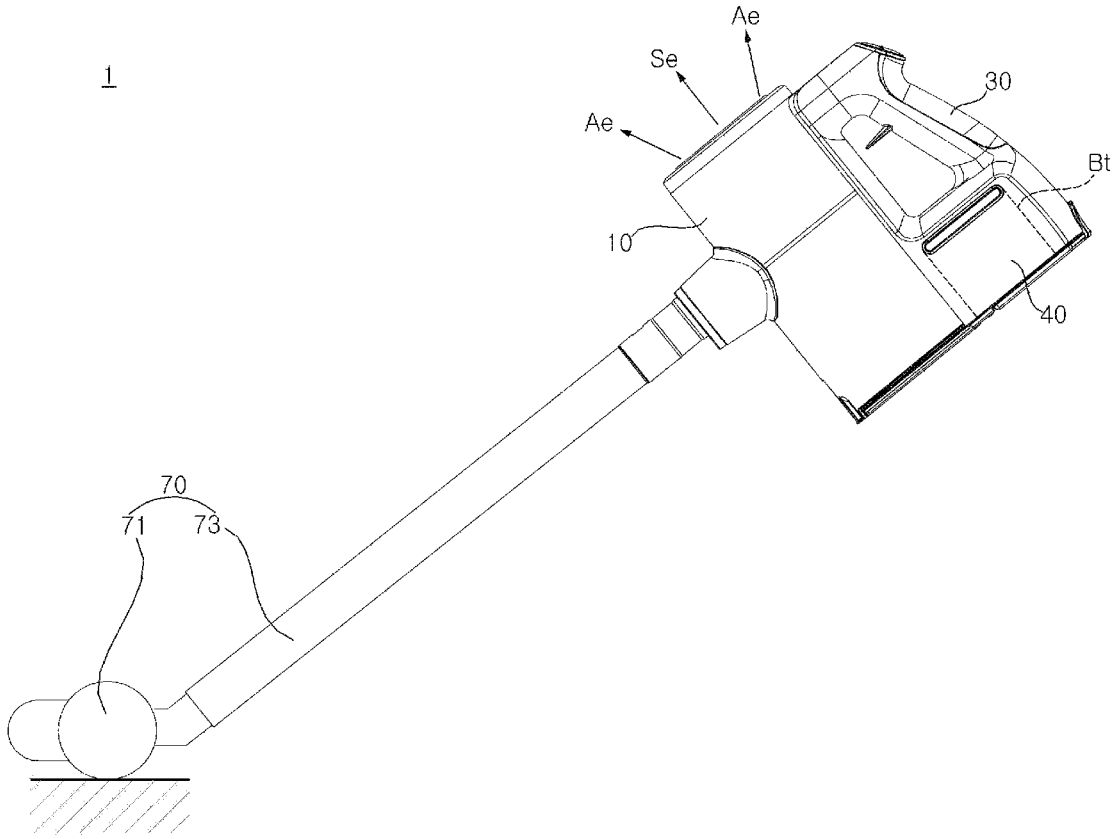
FIG. 1 is a side elevation view showing a state of use of a cleaner 1 according to an embodiment of the present disclosure.
Figure 2:
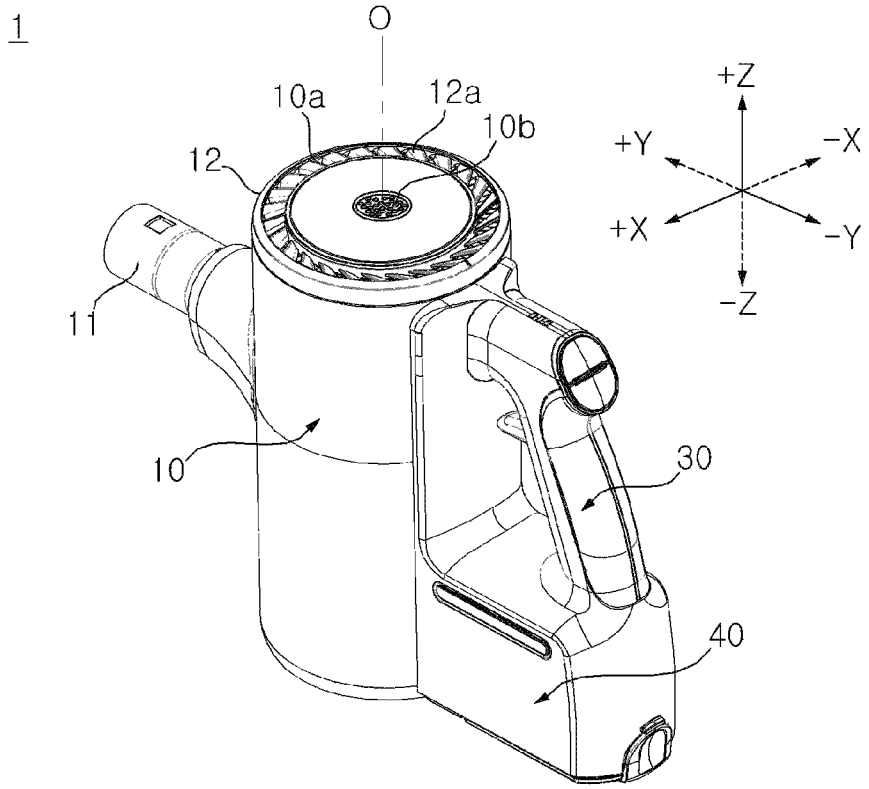
FIG. 2 is a perspective view of the cleaner 1 from which a nozzle module 70 is removed from FIG. 1.
Figure 3:
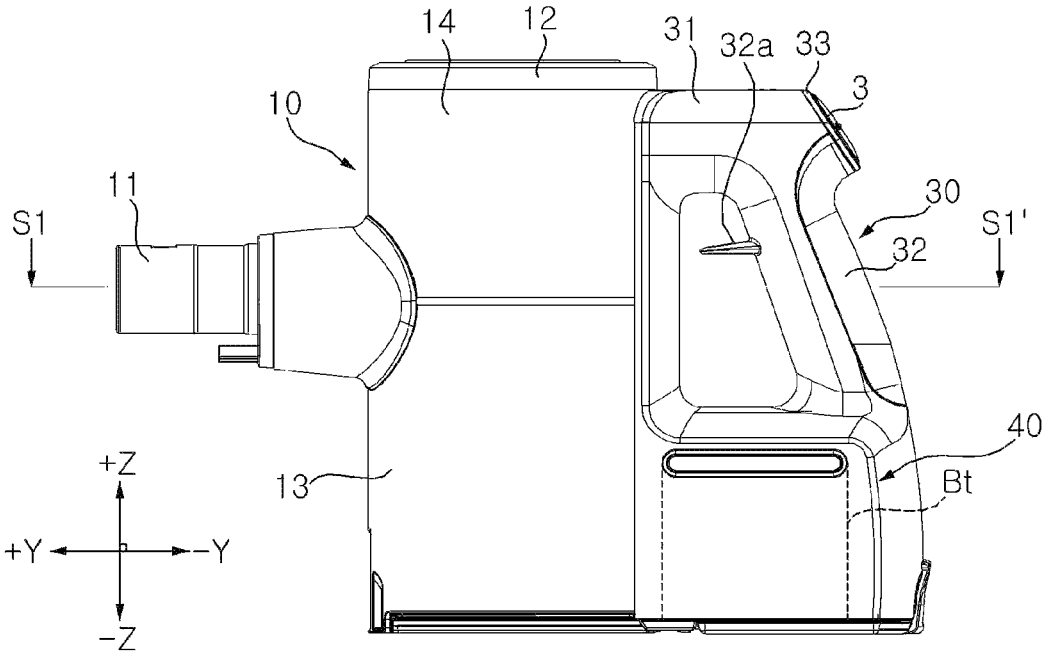
FIG. 3 is a side elevation view of the cleaner 1 of FIG. 2.
Figure 4A:
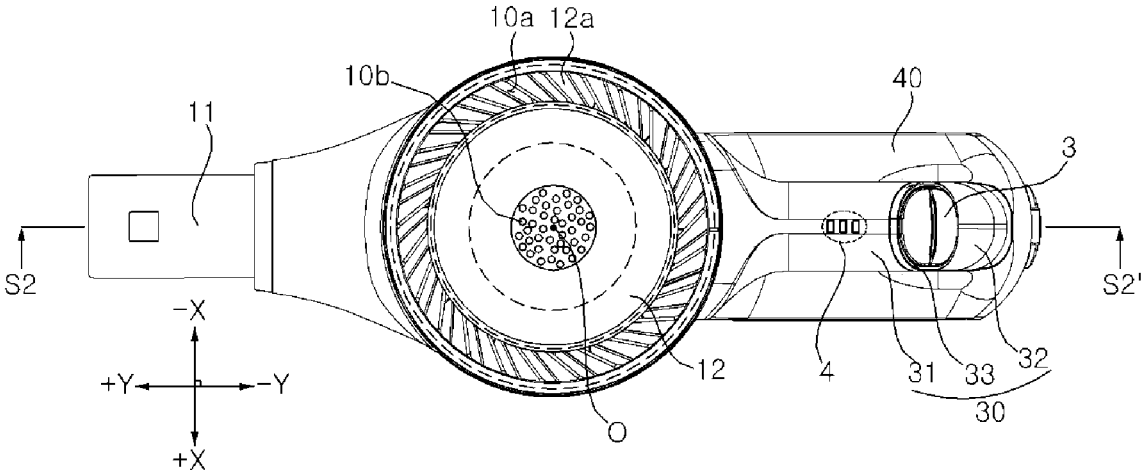
FIG. 4A is a top elevation view of the cleaner 1 of FIG. 2.
Figure 4B:
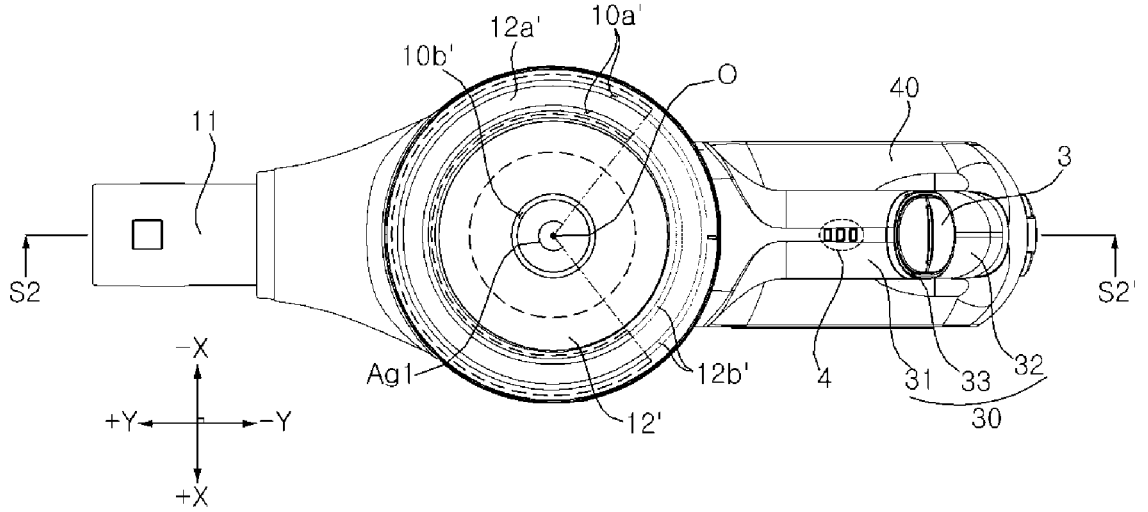
FIG. 4B is a top elevation view of a cleaner 1 according to another embodiment.

The present disclosure will be described below based on a spatial Cartesian coordinate system formed by the X-axis, Y-axis, and Z-axis that are orthogonal to each other. Each axial direction (X-axis direction, Y-axis direction, Z-axis direction) means both directions in which each axis extends. A '+' sign in front of each axis direction (+X-axis direction, +Y-axis direction, +Z-axis direction) means a positive direction, which is one of both directions in which each axis extends. A '−' sign in front of each axis direction (−X-axis direction, −Y-axis direction, −Z-axis direction) means a negative direction, which is the other of both directions in which each axis extends.

Although expressions designating directions such as "front (+Y)/rear (−Y)/left (+X)/right (−X)/up (+Z)/down (−Z)" mentioned below is defined according to the XYZ coordinate axis, these are simply given to explain the present disclosure for clear understanding, and it is obvious that the respective directions may be defined in different ways depending on the reference point.

The use of terms with the expression 'first, second, third, etc.' in front of the elements mentioned below is only used to avoid confusion of the elements, and is not related to the order, importance, or master/slave relationships between elements, or the like. For example, an invention including only a second element without a first element can be implemented.

An expression of the singular number used herein may include an expression of the plural number unless clearly defined otherwise in the context.

The cleaner according to the present disclosure may be a manual cleaner or a robot cleaner. That is, if a manual cleaner, which is represented by a handy-type, a canister, and an upright type, and a robot cleaner, which is capable of autonomous driving of a cleaning space, include a flow path identical or similar to the present disclosure, the inventions defined in the claims of the present disclosure can be applied.

Hereinafter, a cleaner 1 according to an embodiment of the present disclosure will be described by taking a handy type manual cleaner as an example.

Referring to FIGS. 1 to 7, the cleaner 1 according to an embodiment includes a main body 10 for forming a flow path P guiding sucked air to be discharged to the outside. The cleaner 1 includes a dust separation unit 20 disposed on the flow path P to separate dust from the air. The cleaner 1 includes a handle 30 coupled to one side of the main body 10.

The cleaner 1 includes a battery Bt for supplying power and a battery housing 40 in which the battery Bt is accommodated. The cleaner 1 includes fan modules 50 and 50' disposed on the flow path P to move air in the flow path. In addition to the dust separation unit 20, the cleaner 1 includes filters 61 and 62 disposed on the flow path P to separate dust from the air.

The cleaner 1 includes a nozzle module 70 detachably connected to a suction pipe 11 of the main body 10. The cleaner 1 includes an input unit 3 through which a user may input on/off of the cleaner 1, a suction mode, or the like, and an output unit 4 that displays various states of the cleaner 1 to the user.

Meanwhile, at a discharge port of the cleaner 1, noise control modules 80, 80', 180, 280, 380, and 980 may be provided that performs at least one of i) a first function to reduce the loudness of noise in the relatively low range among audible frequencies, and ii) a second function to increase the loudness of noise in the relatively high range among audible frequencies. The noise control module may include speakers 89 and 989 that output sound. According to an embodiment, the cleaner 1 may further include the sound transmission tube 90 for transmitting sound from the speakers 89 and 989 to the sound emission ports 10*b* and 10*b'*.

Referring to FIG. 1, the nozzle module 70 includes a nozzle part 71 provided to suck in outside air and an extension pipe 73 extending from the nozzle part 71. The extension pipe 73 connects the nozzle part 71 to the suction pipe 11. The extension pipe 73 guides the air sucked from the nozzle part 71 to be introduced into a suction flow path P1. One end of the extension pipe 73 may be detachably coupled to the suction pipe 11 of the main body 10. The user may clean while holding the handle 30 and moving the nozzle part 71 in a state of placing the nozzle part 71 on the floor.

Referring to FIGS. 2 to 7, the main body 10 forms the exterior of the cleaner 1. The main body 10 may be formed in a vertically long cylindrical shape as a whole. The dust separation unit 20 is accommodated in the main body 10. The fan modules 50 and 50' are accommodated inside the main body 10. The main body 10 includes the suction pipe 11 for guiding the suction of air into the main body 10. The suction pipe 11 forms the suction flow path P1. The suction pipe 11 may protrude forward of the main body 10. In addition, the handle 30 is coupled in the opposite direction of the suction pipe 11 with respect to the main body 10. In addition, a battery Bt for supplying power to the fan modules 50 and 50 ' may be mounted under the handle 30.

The main body 10 includes discharge covers 12 and 12' forming exhaust ports 10*a* and 10*a*'. The discharge covers 12 and 12 ' may form an upper surface of the main body 10. The discharge covers 12 and 12' cover the upper portion of a fan module housing 14.

The main body 10 includes a dust collection unit 13 for storing dust separated by the dust separation unit 20. At least a portion of the dust separation unit 20 may be disposed in the dust collection unit 13. The inner surface of the upper portion of the dust collection unit 13 may perform a function of a first cyclone part 21 to be described below (In this case, the upper part of the dust collection unit 13 may be referred to as the first cyclone part 21). A second cyclone part 22 and a dust flow guide 24 are disposed in the dust collection unit 13.

The dust collection unit 13 may be formed in a cylindrical shape. The dust collection unit 13 is disposed under the fan module housing 14. Dust storage spaces S1 and S2 are formed in the dust collection unit 13. A first storage space S1 is formed between the dust collection unit 13 and the dust flow guide 24. A second storage space S2 is formed in the dust flow guide 24.

The main body 10 includes the fan module housing 14 for accommodating the fan modules 50 and 50' therein. The fan module housing 14 may be formed to extend upward from the dust collection unit 13. The fan module housing 14 is formed in a cylindrical shape. An extension part 31 of the handle 30 is disposed on the opposite side of the suction pipe 11 with respect to the fan module housing 14.

The main body 10 includes a dust cover 15 provided to open and close the dust collection unit 13. The dust cover 15 may be rotatably coupled to the lower side of the dust collection unit 13. The dust cover 15 may open and close the lower side of the dust collection unit 13 by a rotating operation. The dust cover 15 may include a hinge (not illustrated) for rotation. The hinge may be coupled to the dust collection unit 13. The dust cover 15 may open and close the first storage space S1 and the second storage space S2 together.

The main body 10 includes an air guide 16 for guiding the air leaked from the dust separation unit 20. The air guide 16 forms fan module flow paths P4 and P4' for guiding air from the dust separation unit 20 to an impeller 52. The air guide 16 includes exhaust flow paths P5 and P5' for guiding the air that has passed through the impeller 52 to the exhaust ports 10*a* and 10*a*'. The air guide 16 may be disposed in the fan module housing 14.

Meanwhile, the fan module 50 may be constituted by the impeller 52, a motor 51 for operating the impeller 52, and a shaft 53 for coupling the motor 51 and the impeller 52. The direction of the flow path sucked into the fan module 50 is determined according to the disposed position and direction of the impeller 52 inside the fan module 50.

Figure 6A:
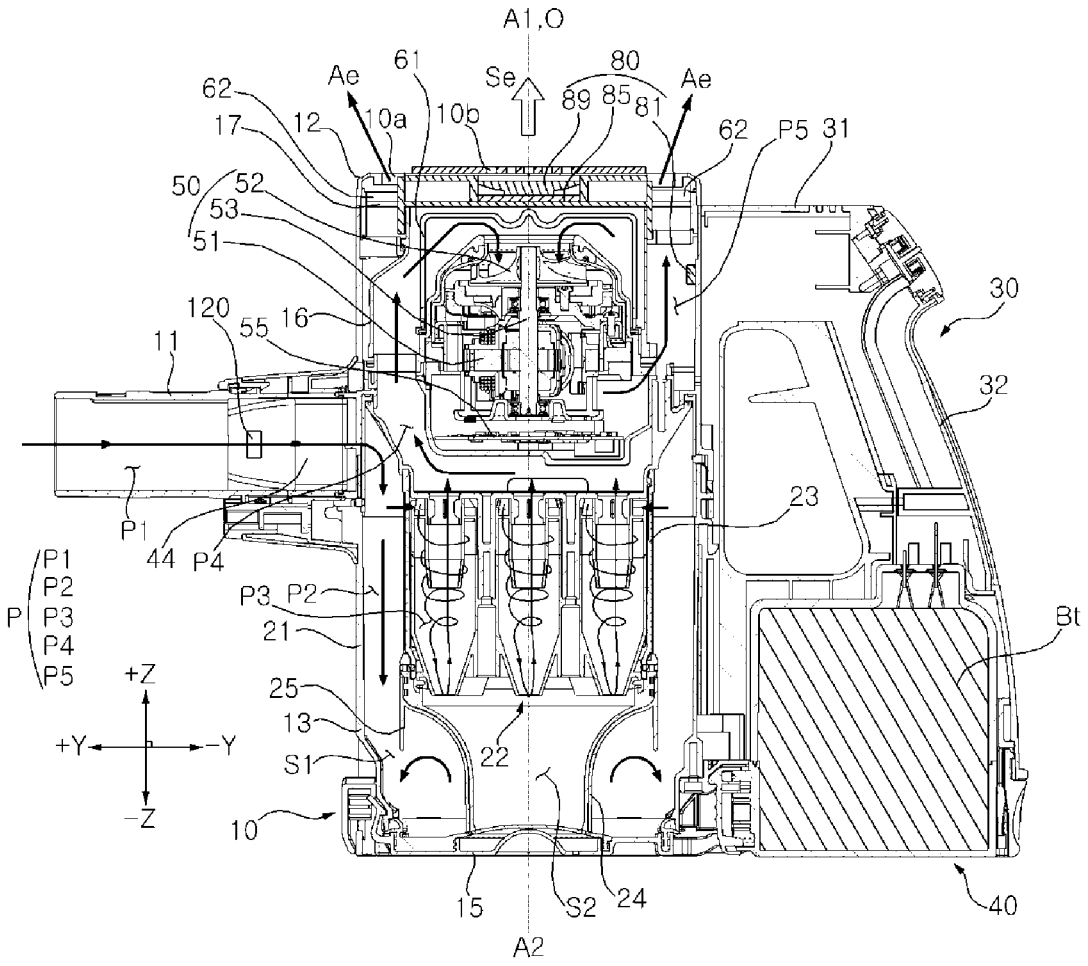
FIGS. 6A to 6C are cross-sectional views of the cleaner 1 of FIG. 4A taken vertically along the line S2-S2'.
Figure 6B:
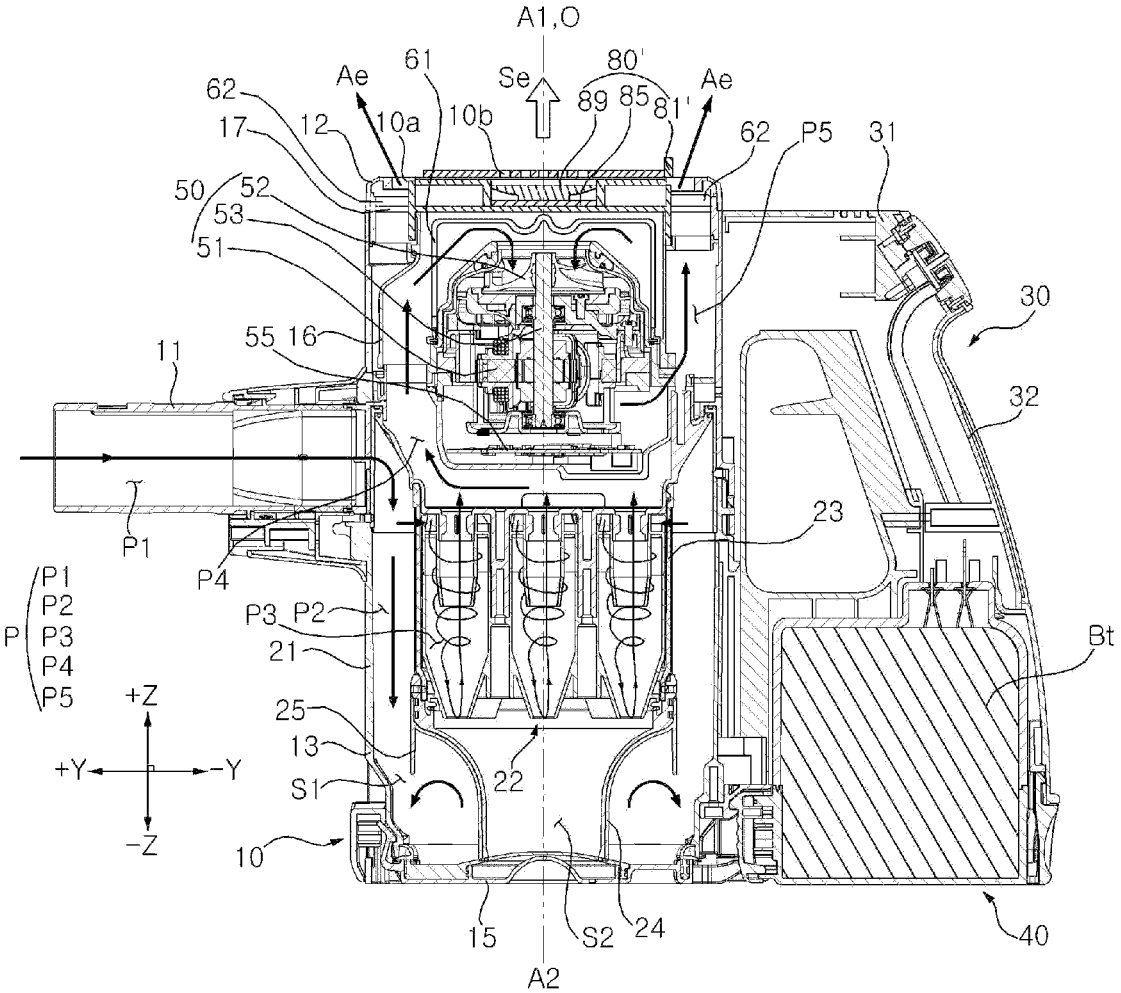
Figure 6C:
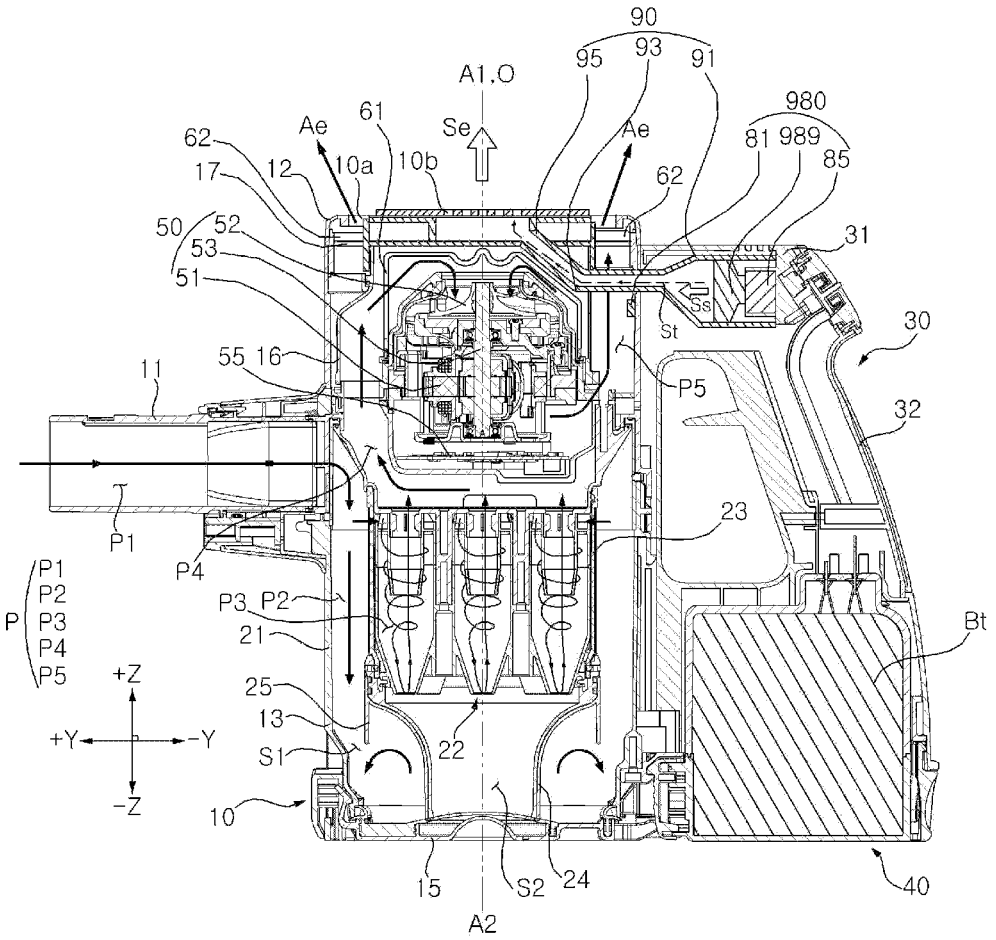

For example, referring to FIGS. 6*a* to 6*c*, when the entrance of the impeller 52 is installed in the direction opposite to the motor 51 above the motor 51, the flow paths P4 and P5 may be formed such that the air leaked from the dust separation unit 20 rises, passes through the impeller 52, and falls, and rises again to the exhaust ports 10*a* and 10*a'*.

Figure 7:
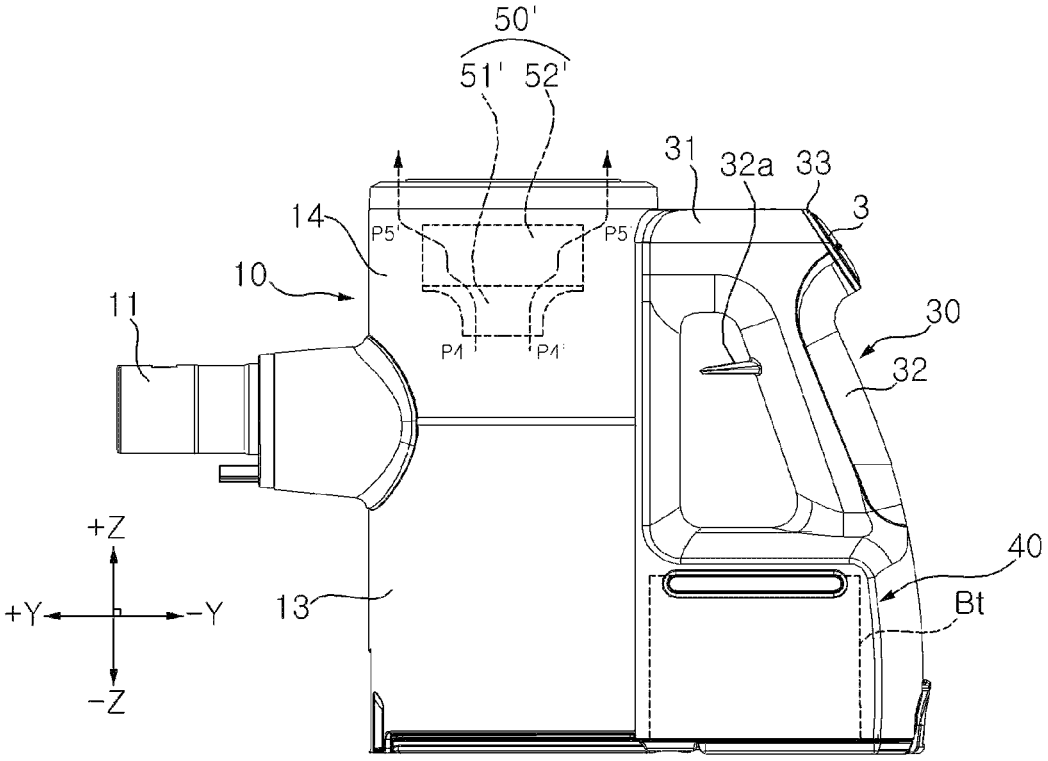
FIG. 7 is a side elevation view showing a fan module 50' and airflow in a cleaner 1 according to another embodiment.

For another example, referring to FIG. 7, when the entrance of the impeller 52 is installed in the direction opposite to the motor 51 under the motor 51, the flow paths P4' and P5' may be formed such that the air leaked from the dust separation unit 20 passes through the impeller 52, and continues to rise to the exhaust ports 10*a* and 10*a'*.

In addition, when the entrance of the impeller 52 is installed to face the motor, the impeller 52 may be installed above the motor 51 in the embodiment of FIG. 7.

With reference to FIGS. 2, 4*a*, 4*b*, and 6*a* to 6*c*, the main body 10 has exhaust ports 10*a* and 10*a* through which air in the flow path P is discharged to the outside of the main body 10. The exhaust ports 10*a* and 10*a*' may be formed in the discharge covers 12 and 12'.

The exhaust ports 10*a* and 10*a*' may be disposed on one surface of the main body 10. The exhaust ports 10*a* and 10*a*' may be disposed on one surface of the main body 10. In this way, it is possible to prevent dust around the cleaner from being scattered by the air discharged from the exhaust ports 10*a* and 10*a*', and to prevent the air discharged from the exhaust ports 10*a* and 10*a*' from hitting the user directly. In addition, the sound emission port may be disposed on the same surface as that on which the exhaust ports 10*a* and 10*a*' are formed among the surfaces of the main body 10.

The exhaust ports 10*a* and 10*a*' may be disposed to face a specific direction (e.g., upward direction). The discharge direction Ae of the air discharged through the exhaust ports 10*a* and 10*a*' may be the specific direction.

Figure 5:
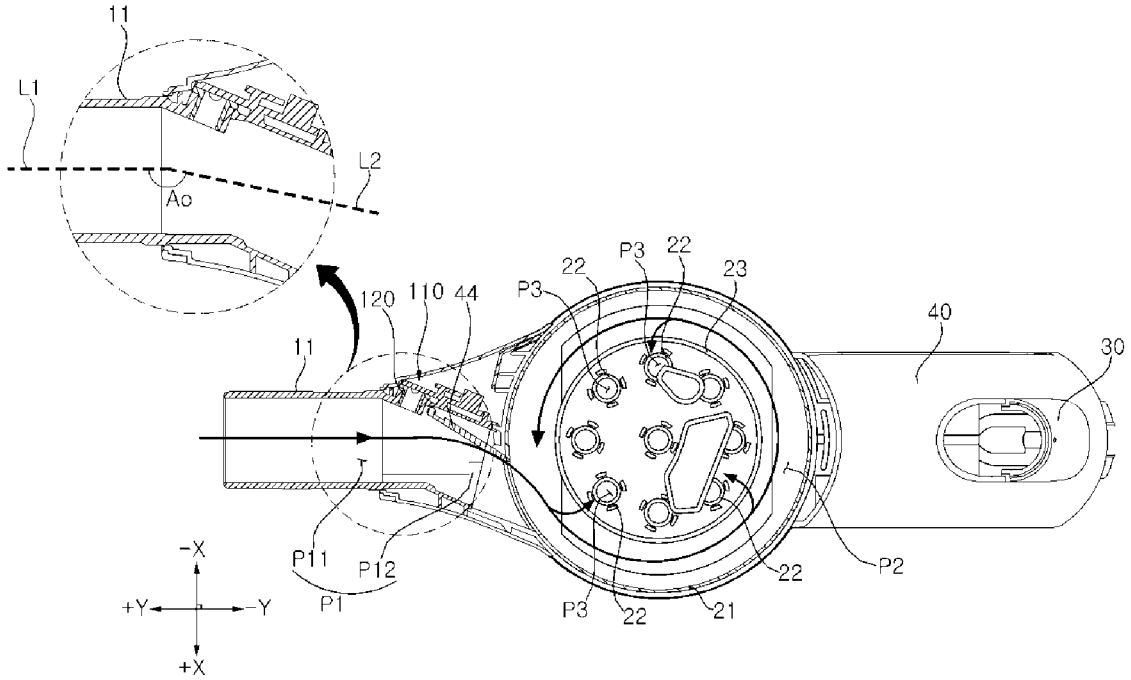
FIG. 5 is a cross-sectional view of the cleaner 1 of FIG. 3 taken horizontally along the line S1-S1'.

Referring to FIGS. 5 to 6*c*, the dust separation unit 20 performs a function of filtering dust on the flow path P. The dust separation unit 20 separates dust sucked into the main body 10 through the suction pipe 11 from the air.

For example, the dust separation unit 20 may include the first cyclone part 21 and the second cyclone part 22 capable of separating dust by cyclone flow. A flow path P2 formed by the first cyclone part 21 may be connected to the suction flow path P1 formed by the suction pipe 11. Air and dust sucked through the suction pipe 11 spirally flow along the inner circumferential surface of the first cyclone part 21.

The axis A2 of the cyclone flow of the first cyclone part 21 may extend in the vertical direction. The axis A2 of cyclone flow may coincide with an axis O. The second cyclone part 22 additionally separates dust from the air that has passed through the first cyclone part 21. The second cyclone part 22 may be located in the first cyclone part 21. The second cyclone part 22 may be located in a boundary portion 23. The second cyclone part 22 may include a plurality of cyclone bodies disposed in parallel.

For another example, the dust separation unit 20 may have a single cyclone part. Even in this case, the axis A2 of the cyclone flow may extend in the vertical direction.

For another example, the dust separation unit 20 may include a main filter unit (not illustrated) instead of a cyclone part. The main filter unit may separate dust from the air introduced from the suction pipe 11.

Hereinafter, the dust separation unit 20 has been described based on the present embodiment including the first cyclone part 21 and the second cyclone part 130, but is not necessarily limited thereto.

The dust separation unit 20 forms dust separation flow paths P2 and P3. The air moves through the dust separation flow paths P2 and P3 at a high speed to separate dust from the air, and the separated dust is stored in the first storage space S1.

The space between the inner circumferential surface of the first cyclone part 21 and the outer peripheral surface of the boundary portion 23 is the flow path P2 of the first cyclone. The air that has passed through the suction flow path P1 moves in a downward spiral direction in the flow path P2 of the first cyclone, and dust in the air is centrifuged. Here, the axis A2 is the axis A2 of the flow in the downward spiral direction.

The dust separation unit 20 includes the boundary portion 23 disposed in a cylindrical shape inside the first cyclone part 21. The boundary portion 23 forms a plurality of holes on the outer peripheral surface. Air in a first cyclone flow path P2 may pass through the plurality of holes of the boundary portion 23 and may flow into a second cyclone flow path P3. The bulky dust may also be filtered by a plurality of holes in the boundary portion 23.

The upper side of the second cyclone part 22 is disposed in the boundary portion 23. The second cyclone part 22 includes a plurality of cyclone bodies having an empty interior and penetrating vertically. Each cyclone body may be formed in a pipe shape that tapers toward the bottom. The second cyclone flow path P3 is formed in each cyclone body. The air passing through the boundary portion 23 moves to the second cyclone flow path P3 along a guide for inducing airflow in a downward spiral direction disposed on the upper side of the cyclone body. The air moves downward spirally along the inner peripheral surface of the cyclone body, and dust in the air is centrifuged, and the separated air is stored in the second storage space S2. The air that has moved along the second cyclone flow path P3 to the lower side of the cyclone body moves upwardly along the central axis in the vertical direction of the second cyclone flow path P3, and is introduced into the fan module flow paths P4 and P4'.

The dust separation unit 20 includes the dust flow guide 24 for dividing the first storage space S1 and the second storage space S2 in the dust collection unit 13. The space between the dust flow guide 24 and the inner surface of the dust collection unit 13 is the first storage space S1. The inner space of the dust flow guide 24 is the second storage space S2.

The dust flow guide 24 is coupled to the lower side of the second cyclone part 22. The dust flow guide 24 contacts the upper surface of the dust cover 15. A portion of the dust flow guide 24 may be formed to have a smaller diameter from the top to the bottom. For example, the upper portion of the dust flow guide 24 may be formed to have a smaller diameter toward the bottom, and the lower portion of the dust flow guide 24 may be formed in a cylindrical shape extending vertically.

The dust separation unit 20 may include a scattering prevention rib 25 extending downward from the upper end of the dust flow guide 24. It may wrap around the upper portion of the dust flow guide 24. The scattering prevention rib 25 may extend along a circumferential direction around the axis A2 of flow. For example, the scattering prevention rib 25 may be formed in a cylindrical shape.

When the upper portion of the dust flow guide 24 is formed to decrease in diameter toward the bottom, space is formed between the outer peripheral surface of the upper portion of the dust flow guide 24 and the scattering prevention rib 25. When the rising flow of air occurs along the dust flow guide 24 in the first storage space S1, dust rising is caught by the space between the scattering prevention rib 25 and the upper portion of the dust flow guide 24. In this way, it is possible to prevent the dust in the first storage space S1 from flowing backward.

The handle 30 is coupled to the main body 10. The handle 30 may be coupled in a direction opposite to the suction pipe 11 with respect to the main body 10. The handle 30 may be coupled to the upper portion of the battery housing 40.

The handle 30 includes an extension part 31 protruding from the main body 10 to the rear and extending. The extension part 31 may extend forward from the upper side of an additional extension part 32. The extension part 31 may extend in a horizontal direction. In embodiment B to be described later, a speaker 989 is disposed in the extension part 31.

The handle 30 extends in the vertical direction and includes the additional extension part 32. The additional extension part 32 may be spaced apart from the main body 10 in a front-rear direction. The user may use the cleaner 1 while holding the additional extension part 32. The upper end of the additional extension part 32 is connected to the rear end of the extension part 31. The lower end of the additional extension part 32 is connected to the battery housing 40.

In the additional extension part 32, a movement limiting part 32*a* may be provided for preventing the hand from moving in the longitudinal direction (up and down direction) of the additional extension part 32 while the user is holding the additional extension part 32. The movement limiting part 32*a* may protrude forward from the additional extension part 32.

The movement limiting part 32*a* is disposed to be spaced apart from the extension part 31 vertically. While the user is holding the additional extension part 32, some fingers of the hand of the user are located above the movement limiting part 32*a*, and the other fingers thereof are located beneath the movement limiting part 32*a*.

The handle 30 may include an inclined surface 33 facing the direction between the upper side and the rear side. The inclined surface 33 may be located at the rear of the extension part 31. An input unit 3 may be disposed on the inclined surface 33.

The battery Bt may supply power to the fan modules 50 and 50'. The battery Bt may supply power to the noise control module. The battery Bt may be detachably disposed in the battery housing 40.

The battery housing 40 is coupled to the rear side of the main body 10. The battery housing 40 is disposed under the handle 30. The battery Bt is accommodated in the battery housing 40. A heat dissipation hole for discharging heat generated from the battery Bt to the outside may be formed in the battery housing 40.

Referring to FIGS. 6*a* to 7, the fan modules 50 and 50 ‘ generate suction force such that outside air is introduced into the flow path P. The fan modules 50 and 50’ are disposed in the main body 10. The fan modules 50 and 50' are disposed below the sound emission ports 10*b* and 10*b'*. The fan modules 50 and 50 ‘ are disposed above the dust separation unit 20.

The fan modules 50 and 50' include impellers 52 and 52' for generating suction force by rotation. The impellers 52 and 52' pressurize the air such that the air in the flow path P is discharged through the exhaust ports 10*a* and 10*a'*. When the impellers 52 and 52' pressurize air, noise and vibration are generated, and the noise is mainly emitted through the exhaust ports 10*a* and 10*a'*.

The extension line of the rotation axis A1 of the impellers 52 and 52' (which may also be referred to as the axis of the suction motor) may coincide with the axis of flow A2.

Further, the rotation axis A1 may coincide with the axis O. In this case, the impellers 52 and 52' rotate around the axis O to pressurize air. In this way, noise may be relatively evenly emitted through the exhaust ports 10*a* and 10*a'* formed in peripheral regions B1 and B1'.

The fan modules 50 and 50' include suction motors 52 and 52' for rotating the impeller 52. The suction motors 52 and 52' may be the only motors of the cleaner 1. The suction motors 52 and 52' may be located above the dust separation unit 20. When the suction motors 52 and 52' operates, noise and vibration are generated, and the noise is mainly emitted through the exhaust ports 10*a* and 10*a'*.

For example, referring to FIGS. 6*a* to 6*c*, the fan module 50 in which the impeller 52 is disposed may be provided under the suction motor 52. The impeller 52 pressurizes air upwardly when rotating.

For another example, referring to FIG. 7, a fan module 50' in which the impeller 51' is disposed may be provided under the suction motor 52'. The impeller 51' pressurizes air downwardly when rotating.

The fan modules 50 and 50' may include the shaft 53 fixed to the center of the impellers 52 and 52'. The shaft 53 is disposed to extend in the vertical direction on the rotation shaft A1. The shaft 53 may function as a motor shaft of the suction motor 52.

Meanwhile, the cleaner 1 may include a printed circuit board (PCB) 55 for controlling the suction motors 52 and 52'. The PCB 55 may be disposed between the suction motor 52 and the dust separation unit 20.

Referring to FIGS. 6*a* to 6*c*, the cleaner 1 may include a pre-filter 61 for filtering air before being sucked into the suction motors 52 and 52'. The pre-filter 61 may be disposed to surround the impeller 52. Air on the fan module flow paths P4 and P4' passes through the pre-filter 61 and reaches the impeller 52. The pre-filter 61 is disposed in the main body 10. The pre-filter 61 is disposed under the discharge covers 12 and 12'. By separating the discharge covers 12 and 12' from the cleaner 1, the user may remove the pre-filter 61 from the inside of the main body 10.

Referring to FIGS. 6*a* to 6*c*, the cleaner 1 may include a HEPA filter 62 that filters air before being discharged through the exhaust ports 10*a* and 10*a'*. The air passing through the impellers 52 and 52' may pass through the HEPA filter 62 and then be discharged to the outside through the exhaust port 10*a*. The HEPA filter 62 is disposed on the exhaust flow path P5.

The discharge covers 12 and 12' may form a filter accommodation space (not illustrated) for accommodating the HEPA filter 62. The filter accommodation space may be formed such that the lower side is open, and thus the HEPA filter 62 may be accommodated in the filter accommodation space under the discharge covers 12 and 12'.

The exhaust port 10*a* may be formed to face the HEPA filter 62. The HEPA filter 62 is disposed under the exhaust ports 10*a* and 10*a'*. The HEPA filter 62 may be disposed to extend in the circumferential direction along the exhaust ports 10*a* and 10*a'*.

The main body 10 includes a filter cover 17 covering the lower side of the HEPA filter 62. In a state in which the HEPA filter 62 is accommodated in the filter accommodation space, the lower side of the HEPA filter 62 is covered by the filter cover 17, and the filter cover 17 is formed with a hole through which air in the exhaust flow path P5 passes. The filter cover 17 may be detachably coupled to the discharge covers 12 and 12'.

The discharge covers 12 and 12' may be detachably coupled to the fan module housing 14. When the filter cover 17 is removed from the exhaust covers 12 and 12' separated from the fan module housing 14, the HEPA filter 62 may be withdrawn from the filter accommodation space.

In the present disclosure, the cleaner 1 has been described as including the pre-filter 61 and the HEPA filter 62; however, there is no limitation on the type and number of filters.

Meanwhile, the input unit 3 may be located on the opposite side of the movement limiting part 32*a* with respect to the handle 30. The input unit 3 may be disposed on the inclined surface 33.

In addition, the output unit 4 may be disposed on the extension part 31. For example, the output unit 4 may be located on the upper surface of the extension part 31. The output unit 4 may include a plurality of emission units 111. The plurality of emission units 111 may be arranged to be spaced apart in the longitudinal direction (front-rear direction) of the extension part 31.

Meanwhile, referring to FIGS. 5 to 7, the flow path p1 is formed by sequentially connecting the suction flow path P1, the dust separation flow paths P2 and P3, and the exhaust flow paths P5 and P5'.

In particular, referring to FIG. 5, the suction flow path P1 provides outside air to the dust separation unit 20. The suction flow path P1 is connected to the dust separation unit 20. Specifically, the suction flow path P1 may be defined by the suction pipe 11, a portion of the suction flow path P1 is exposed to the outside of the main body 10, and the other side of the suction flow path P1 may be located in the main body 10. One side of the suction flow path P1 may be coupled to the extension pipe 73 connected to the nozzle part 71. The air in the suction flow path P1 is moved by the fan module.

The suction flow path may include a first suction flow path P11 extending in the first direction, and a second suction flow path P12 connecting the first suction path P11 to the dust separation unit 20 and extending in the second direction forming an obtuse angle with the first direction.

The first suction flow path P11 may have the form of a straight line extending in the first direction. Specifically, the suction pipe 11 defining the first suction flow path P11 may be a straight pipe extending in the first direction. At least a portion of the first suction flow path P11 is exposed to the outside of the main body 10. The extension line in the first direction meets the rotation axis of the fan module (axis A2 of cyclone flow).

One end of the second suction flow path P12 is connected to the first suction flow path P11 and the other end thereof is connected to the dust separation unit 20. The second suction flow path P12 communicates with the dust separation flow path P2 of the dust separation unit 20. The second suction flow path P12 is located in the main body 10.

The second suction flow path P12 changes the direction of the introduced air and reduces the flow rate of the introduced air so that the air entering the dust separation unit 20 performs a cyclone movement around the axis A2 of the cyclone flow.

Specifically, the second suction flow path P12 may extend in a second direction L2 forming an obtuse angle with a first direction L1. The second suction flow path P12 may have a straight-line or a curved-line shape. It is desirable that the angle A0 formed by the first suction flow path P11 and the second suction flow path P12 is 150 degrees to 170 degrees. The first direction is the front-rear direction, and the angle A0 formed by the first suction flow path P11 and the second suction flow path P12 is an angle measured on the front, rear, right and left planes.

The first suction flow path P11 is a passage for introducing dust and air sucked from the nozzle part 71 into the dust separation unit 20. The air moving through the first suction flow path P11 has to maintain a flow rate such that dust and air do not flow back in the middle of the movement.

The first suction flow path P11 may be defined as a region in which the flow rate is the fastest in the suction pipe 11. Further, the first suction flow path P11 may be defined as a region in which the flow rate is relatively faster than other regions in the suction pipe 11.

The second suction flow path P12, which forms a primary cyclone entrance at the end of the first suction flow path P11 through the outer wall of the suction pipe 11 and a flap door 44, may be defined as a region where the flow rate in the suction pipe 11 is slower than that in the first suction flow path P11.

The suction pipe 11 is provided with the flap door 44 for opening and closing the suction pipe 11. The flap door 44 is rotatably installed in the second suction flow path P12 and opens and closes the suction flow path according to the pressure in the second suction flow path P12.

Air and dust sucked through the suction flow path P1 by the operation of the suction motors 52 and 52' flow in the first flow path P2 and the second cyclone flow path P3 and are separated from each other. In the second cyclone flow path P3, air moves upward as described above, and flows into the fan module flow paths P4 and P4'.

The fan module flow paths P4 and P4' guide air toward the pre-filter 61. The air that has sequentially passed through the pre-filter 61 and the impeller 52 flows into the exhaust flow paths P5 and P5'. The air in the exhaust flow paths P5 and P5' passes through the HEPA filter 62 and is then discharged to the outside through the exhaust ports 10*a* and 10*a'*.

For example, referring to FIGS. 6*a* to 6*c*, the fan module flow path P4 guides the air such that the air discharged from the dust separation unit 20 rises and then passes through the impeller 52 and falls. Here, the exhaust flow path P5 guides the air such that the fallen air while passing through the impeller 52 rises again to the exhaust ports 10*a* and 10*a'*.

For another example, referring to FIG. 7, the fan module flow path P4 ' guides the air such that the air discharged from the dust separation unit 20 passes through the impeller 52 and continuously rises. Here, the exhaust flow path P5' guides the air such that the rising air while passing through the impeller 52 continuously rises to the exhaust ports 10*a* and 10*a'*.

The present disclosure may be equipped with the dust sensor 110. The dust sensor 110 measures the concentration of dust in the suction flow path.

Referring to FIG. 5, the dust sensor 110 measures the concentration of dust in the suction flow path and provides information on the concentration of dust to a control unit. When the dust sensor 110 is disposed far away from the main body 10, electricity supply and communication are difficult, manufacturing is difficult, manufacturing cost increases, and when the dust sensor 110 is disposed outside the main body 10, there is a possibility that the dust sensor 110 is damaged when the cleaning tool is replaced. In order to solve the problem described above, the dust sensor 110 of the present disclosure is disposed in the second suction flow path P12.

When the dust sensor 110 is disposed in the second suction flow path P12, it is disposed in the main body 10 and the distance thereof to the power supply unit is close, and thus power supply is advantageous, and there is little risk of damage to the dust sensor 110 when the cleaning tool is replaced. In addition, since the second suction flow path P12 changes the direction of the flow and decreases the flow rate, the concentration of dust may be accurately and quickly measured.

Specifically, the dust sensor 110 may be disposed closer to the first suction flow path P11 than the dust separation unit 20 in the second suction flow path P12. It may be desirable that the dust sensor 110 is disposed closer to the first suction flow path P11 than the flap door 44. When the dust sensor 110 is disposed adjacent to the first suction flow path P11, the possibility of damage of the dust sensor 110 due to the movement of the flap door 44 may decrease, and thus the remaining space of the main body 10 can be utilized.

Figure 8A:
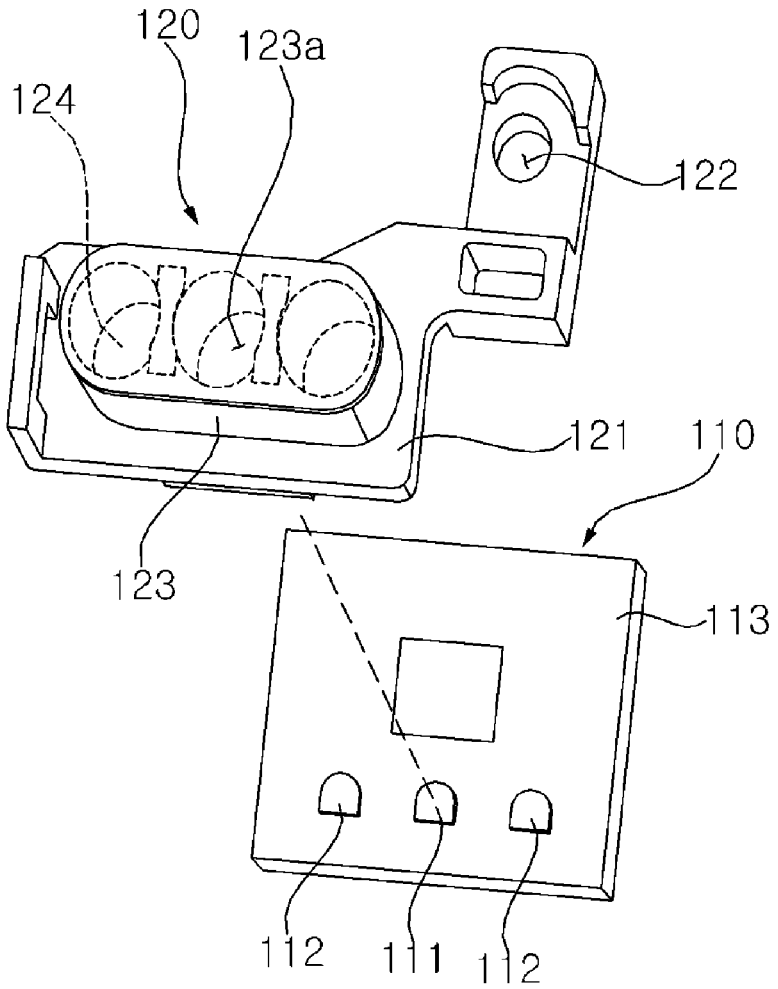
FIG. 8A is an exploded perspective view of a dust sensor and a sensor cover according to an embodiment of the present disclosure.
Figure 8B:
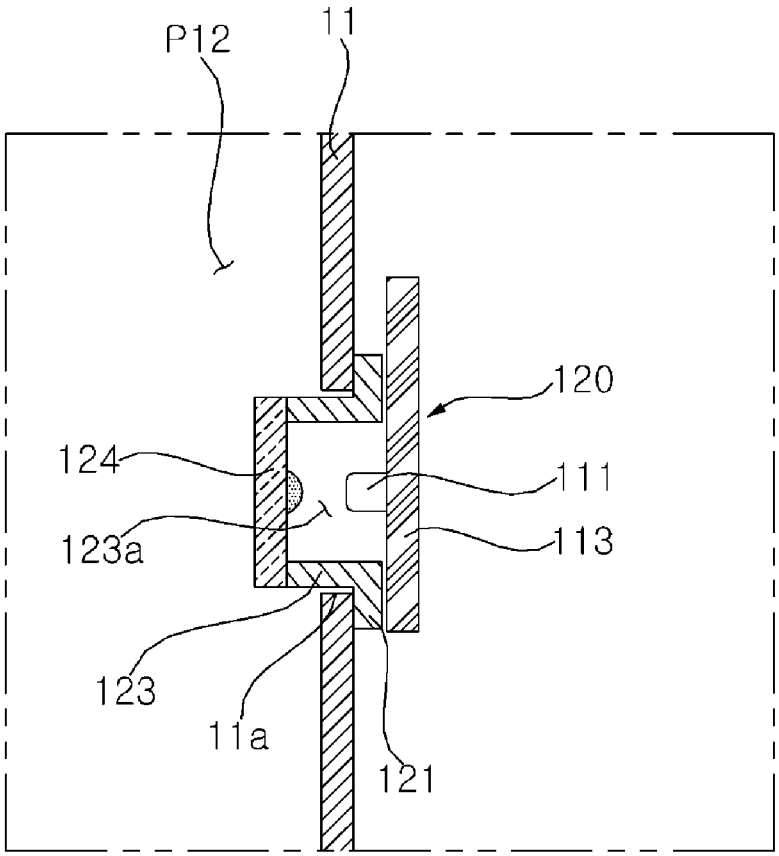
FIG. 8B is a cross-sectional view showing the dust sensor and the sensor cover coupled to a suction pipe according to an embodiment of the present disclosure.

Hereinafter, referring to FIGS. 8A and 8B, a configuration of the dust sensor 110 will be described.

The dust sensor 110 measures the concentration of dust in the air by emitting light and measuring returned light from the emitted light.

For example, the dust sensor 110 includes an emission unit 111 for emitting light and a reception unit 112 for receiving light emitted from the emission unit 111. The emission unit 111 may include a light source for emitting light. Specifically, the emission unit 111 may include a light-emitting diode. The reception unit 112 may include a light-receiving diode for detecting the returned light.

The emission unit 111 and the reception unit 112 may be disposed to correspond to each other. The emission unit 111 and the reception unit 112 may be installed adjacent to each other so as to face the same direction, or may be disposed to face each other (embodiment of FIG. 9).

The emission unit 111 and the reception unit 112 are disposed to face the same direction in the second suction flow path P12. The emission unit 111 may be disposed on one side of the suction pipe 11 defining a suction flow path, and the reception unit 112 may be disposed adjacent to the emission unit 111 on one side of the suction pipe 11. In this case, a direction in which the emission unit 111 and the reception unit 112 faces, and a direction in which the emission unit 111 emits light may be a direction crossing the first direction. It may be desirable that the direction in which the emission unit 111 and the reception unit 112 faces, and a direction in which the emission unit 111 emits light may be a direction orthogonal to the first direction.

The dust sensor 110 may further include a substrate 113 on which the emission unit 111 and the reception unit 112 are disposed. The substrate 113 may be a printed circuit board. The emission unit 111 and the reception unit 112 are disposed on one substrate 113. Specifically, at least two reception units 112 may be located and the emission unit 111 may be located between two reception units 112.

The present disclosure may further include a sensor cover 120 for covering the dust sensor 110. The sensor cover 120 protects the dust sensor 110, facilitates installation when the dust sensor 110 is mounted on the suction flow path, and prevents air in the suction flow path from leaking to the outside.

The sensor cover 120 may define a portion of the suction pipe 11 defining the second suction flow path P12. Specifically, a sensor hole 11*a* through which a portion of the sensor cover 120 penetrates may be formed in the suction pipe 11, and a portion of the sensor cover 120 may pass through the sensor hole 11*a* to be exposed to the inside of the suction pipe 11. A portion of the sensor cover 120 may block the sensor hole 11*a*.

For example, the sensor cover 120 may include an accommodation part 123, a window 124, and a cover support part 121.

The accommodation part 123 accommodates at least one of the emission unit 111 and the reception unit 112. The accommodation part 123 has a shape having openings 123*a* on both sides. The accommodation part 123 is inserted into the sensor hole 11*a* to block the sensor hole 11*a*, and the emission unit 111 located in the sensor hole 11*a* emits light toward the inside of the suction pipe 11. The accommodation part 123 can include a protrusion that is inserted into the sensor hole 11*a* and defines the openings 123*a*.

The accommodation part 123 may guide the light emitted from the emission unit 111 and may guide the light to be received by the reception unit 112. Specifically, the accommodation part 123 includes an impermeable material. The accommodation part 123 may be made of a material different from the window 124 or may be made of the same material as the window 124 and painted. It is desirable in terms of manufacturing that the accommodation part 123 is made of the same material as the cover support part 121.

The window 124 transmits light. Light from the emission unit 111 is emitted through the window, and the light is received by the reception unit 112. The window 124 covers an opening on one side of the accommodation part 123. The window 124 may be flat, or may have a concave lens shape on one side and a convex lens shape on the other side.

The cover support part 121 may be connected to the accommodation part 123 and may extend outward from the accommodation part 123. The cover support part 121 may have a larger size than the accommodation part 123. The cover support part 121 is connected to the accommodation part 123 such that the opening on the other side of the accommodation part 123 is exposed. The cover support part 121 covers the edge of the sensor hole 11*a* to block air flowing in through the sensor hole 11*a*.

The cover support part 121 extends in a direction crossing the opening direction of the accommodation part 123 on the other side of the accommodation part 123 on which the window 124 is not installed. A fastening unit for fastening the suction pipe 11 and the cover support part 121 may be formed on the cover support part 121. Specifically, the fastening unit may be a fastening hole 122 through which the screw passes.

The cover support part 121 may be coupled to the suction pipe 11 defining the second suction flow path P12. One surface of the cover support part 121 may be in contact with the suction pipe 11 defining the second suction flow path P12. One surface of the cover support part 121 may contact a region around the sensor hole 11*a* among the outer surfaces of the suction pipe 11.

The other surface facing one surface of the cover support part 121 may be in contact with one surface of the substrate 113. One surface of the substrate 113 in contact with the other surface of the cover support part 121 is a surface on which the reception unit 112 or the emission unit 111 is disposed. The cover support part 121 contacts one surface of the substrate 113 to prevent air or dust from flowing out through the window 124.

The cover support part 121 and the substrate 113 may be disposed outside the suction pipe 11, and at least one of the window 124, the emission unit 111 and the reception unit 112 may be located in the sensor hole 11*a* or in the suction pipe 11. The cover support part 121 may have a plate shape or include a protrusion extending outward from an end of the accommodation part 123.

Hereinafter, a cleaner according to a second embodiment will be described. Hereinafter, a description will be made mainly on differences from FIG. 5 and the same description will be omitted. Configurations without specific descriptions are regarded as the same as in FIG. 5.

Figure 9:
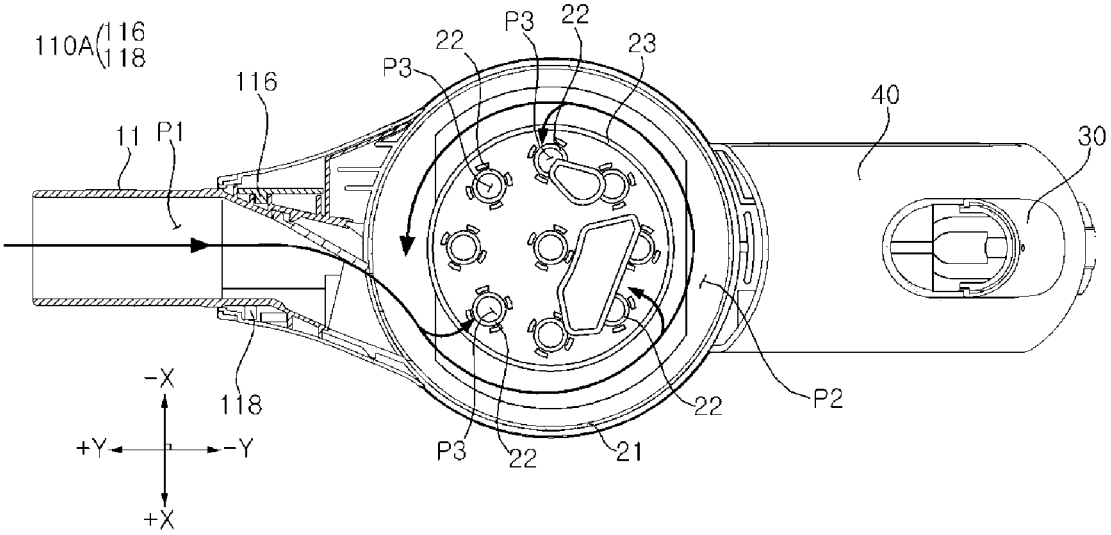
FIG. 9 is a horizontal cross-sectional view of a cleaner according to another embodiment of the present disclosure.

FIG. 9 is a horizontal cross-sectional view of a cleaner according to another embodiment of the present disclosure. Referring to FIG. 9, an emission unit 116 and a reception unit 118 of a dust sensor 110A may be disposed at positions facing each other in a second suction flow path P12. The reception unit 118 is disposed at a position corresponding to the emission unit 116 to receive light emitted from the emission unit 116. For example, the emission unit 116 can include an electric circuit, a light emitter, a light emitting diode, or the like configured to emit light (e.g., infrared light), and the reception unit 118 can include an electric circuit, a light receiver, a light sensor, or the like configured to receive or detect light.

The emission unit 116 may be disposed on one side of the suction pipe 11 defining a suction flow path, and the reception unit 118 may be disposed facing the emission unit 116 on the other side of the suction pipe 11. Specifically, on a horizontal cross-section, the emission unit 116 is disposed on the right side of the suction pipe 11, and the reception unit 118 is disposed on the left side of the suction pipe 11.

By separating or coupling the emission unit 116 and the reception unit 118 based on the space within the main body 10, space utilization within the main body 10 may be maximized.

Figure 10:
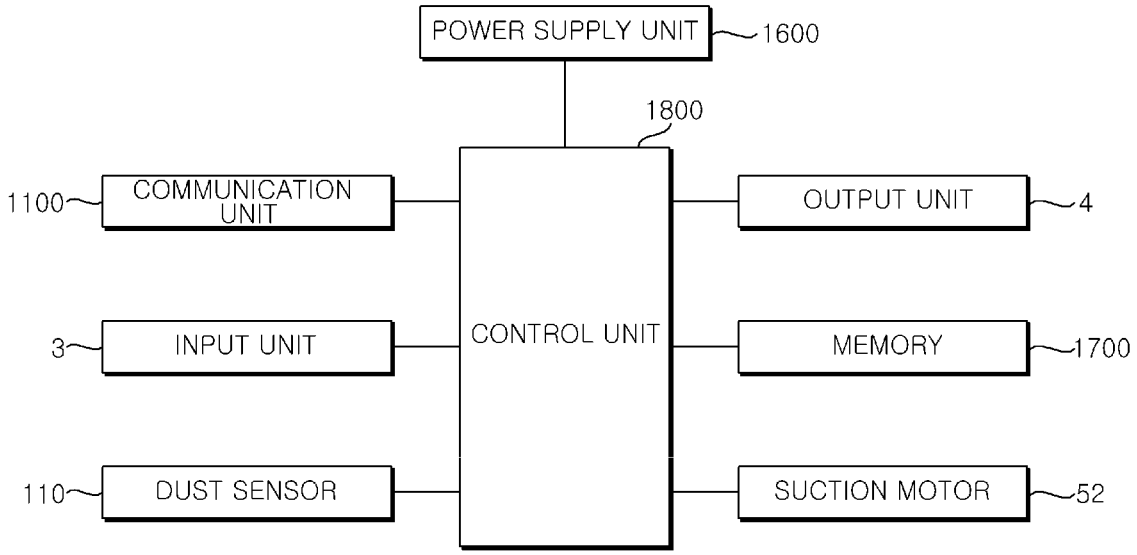
FIG. 10 is a block diagram showing exemplary components of a cleaner according to an embodiment of the present disclosure.

In FIG. 10 below, an embodiment related to the control component of the cleaner 100 will be described.

The cleaner 100 according to an embodiment of the present disclosure may include at least one of a communication unit 1100, an input unit 3, a dust sensor 110, an output unit 4, a power supply unit 1600, a memory 1700, and a control unit 1800, the suction motor 52 or a combination thereof.

In this case, since the components illustrated in FIG. 10 are not essential, it is obvious that a cleaner having more components or fewer components may be implemented. In addition, as described above, the plurality of robot cleaners described in the present disclosure may include only some of the components described below as the same components.

Hereinafter, each of the components will be described. First, the power supply unit 1600 is provided with a battery that may be charged by an external commercial power source to supply power into the cleaner. The power supply unit 1600 may supply driving power to each of the components included in the cleaner to supply operation power required to drive the cleaner or perform a specific function.

In this case, the control unit 1800 may detect the remaining power of the battery, and when the remaining power is insufficient, the control unit 1800 may perform control to move to a charging station connected to the external commercial power source, and receive a charging current from the charging station to charge the battery. The battery may be connected to a battery detection unit to transmit the remaining power of the battery and the state of charge to the control unit 1800. The control unit 1800 may display the remaining power of the battery on the output unit 4.

The control unit 1800 performs an information processing function based on artificial intelligence technology, and may include at least one module for performing at least one of learning of information, reasoning of information, perception of information, and processing of natural language.

The control unit 1800 may use machine running technology to perform at least one of learning, reasoning, and processing of a vast amount of information, such as information stored in the cleaner, environment information around a mobile terminal, or information stored in a communicable external storage.

In addition, the control unit 1800 may use information learned using machine learning technology to predict (or infer) at least one executable operation of the cleaner, and may control the cleaner to execute the most feasible one of at least one predicted operations. Machine learning technology is a technology for collecting and learning large-scale information based on at least one algorithm, and determining and predicting information based on the learned information.

Information learning is an operation for quantifying the relationship between information and information by grasping the characteristics, rules, and criteria of determination of information, and predicting new data using the quantified pattern.

Algorithms used in machine learning technology may be algorithms based on statistics, for example, a decision tree using a tree structure as a predictive model, an artificial neural network for mimicking the neural network structure and function of living things, genetic programming based on the evolutionary algorithm of living things, clustering for distributing observed examples into subsets called clusters, a Monte Carlo method for calculating function values as a probability through randomly extracted random numbers, or the like.

As a field of machine learning technology, deep learning technology is a technology for performing at least one of learning, determining, and processing information by using an artificial neural network (DNN) algorithm. The artificial neural network (DNN) may have a structure that connects layers and layers and transfers data between layers. Such deep learning technology may learn a vast amount of information through the artificial neural network (DNN) by using a graphic processing unit (GPU) optimized for parallel computation.

The control unit 1800 may use training data stored in an external server or memory, and may mount a learning engine for detecting features for recognizing a predetermined object. In this case, the features for recognizing an object may include the size, shape, and shade of the object.

Specifically, the control unit 1800 may calculate a corresponding current value of the suction motor corresponding to the concentration of dust based on information on the concentration of dust provided by the dust sensor 110 provided in the cleaner, and may control the suction motor based on the calculated corresponding current value of the suction motor.

In addition, the control unit 1800 outputs information on the concentration of dust provided from the dust sensor 110 provided in the cleaner through the output unit 4.

Meanwhile, the input unit 3 receives various control commands for the cleaner from the user. The input unit 3 may include one or more buttons.

In addition, the input unit 3 may be installed on the top of the main body 10 by using a hard key, a soft key, a touchpad, or the like. In addition, the input unit 3 may have the form of a touch screen together with the output unit 4.

Meanwhile, the output unit 4 may be installed on the top of the cleaner. Of course, the installation location and installation form may vary. For example, the output unit 4 may display a battery state or a traveling method on a screen.

The output unit 4 may be formed of any one element of a light-emitting diode (LED), a liquid crystal display (LCD), a plasma display panel, and an organic light-emitting diode (OLED)).

The output unit 4 may further include a sound output unit for aurally outputting an operation process or operation result of the cleaner performed by the control unit 1800. For example, the output unit 4 may output a warning sound to the outside according to the warning signal generated by the control unit 1800.

In this case, the sound output unit (not illustrated) may be a unit for outputting sound such as a beeper or a speaker, and the output unit 4 may output audio data, message data, or the like, having a predetermined pattern stored in the memory 1700 to the outside through the sound output unit.

The memory 1700 stores a control program for controlling or driving the cleaner and data corresponding thereto. The memory 1700 may store audio information, image information, obstacle information, location information, map information, and the like. In addition, the memory 1700 may store information related to a traveling pattern.

As the memory 1700, a non-volatile memory is mainly used. Here, the non-volatile memory (NVM, NVRAM) is a storage device capable of maintaining stored information even when power is not supplied, and examples thereof may include read-only memory (ROM), flash memory, magnetic computer memory (e.g., hard disk, diskette drive, magnetic tape), optical disk drive, magnetic RAM, PRAM, or the like.

Meanwhile, the communication unit 1100 is connected to a terminal device and/or another device located in a specific region (in the present specification, it will be used interchangeably with the term "home appliance") through one of wired, wireless, and satellite communication methods to transmit and receive signals and data.

The communication unit 1100 may transmit and receive data to and from the other device located within a specific region. In this case, the other device may be any device capable of transmitting and receiving data through the connection to a network, and for example, may be an air conditioner, a heating device, an air purification device, a lamp, a TV, or a car. In addition, the other device may be devices for controlling doors, windows, water valves, gas valves, and the like. In addition, the other device may be a sensor for detecting temperature, humidity, atmospheric pressure, gas, and the like.

Hereinafter, a control method according to an embodiment of the present disclosure will be described.

Figure 11:
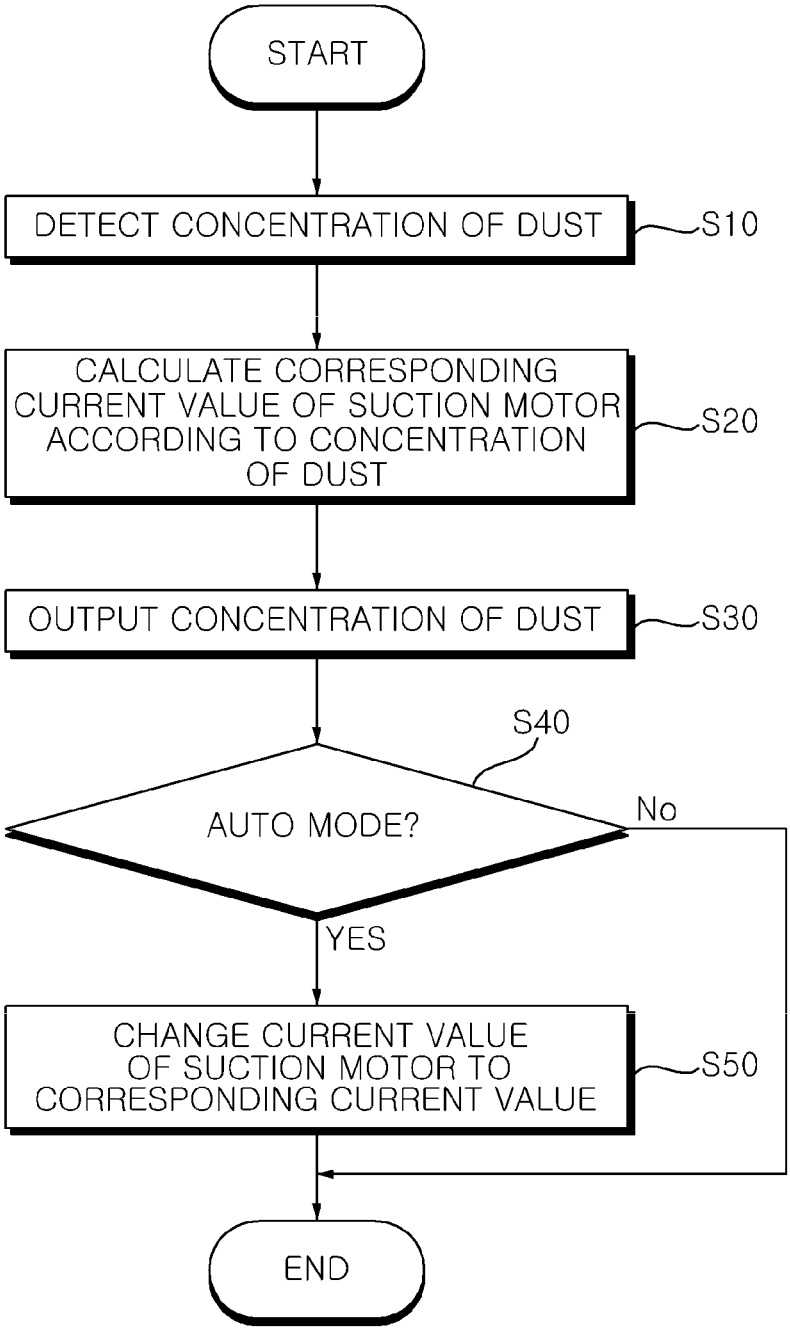
FIG. 11 is a flowchart showing a method of controlling a cleaner according to an embodiment of the present disclosure.

Referring to FIG. 11, the dust sensor 110 detects concentration of dust introduced air, and provides the detected the concentration of dust to the control unit 1800 (S10).

The cleaner may control the suction motor and the output unit 4 based on the detected concentration of dust.

Specifically, based on information on the concentration of dust provided by the dust sensor 110 provided in the cleaner, the control unit 1800 calculates a corresponding current value of the suction motor corresponding to the concentration of dust (S20). The corresponding current value of the suction motor is a predetermined value according to the concentration of dust. The corresponding current value of the suction motor is usually larger as the concentration of dust is large.

The control unit 1800 may control the suction motor based on the calculated corresponding current value of the suction motor, and the control unit 1800 may output the information on the concentration of dust provided by the dust sensor 110 provided in the cleaner through the output unit 4 (S30).

For example, in the auto mode and the manual mode, the control unit 1800 may change the current value of the suction motor to the calculated corresponding current value. When the current value of the suction motor is changed, the suction power of the cleaner is changed.

For another example, the control unit 1800 may determine whether the cleaner operates in the auto mode (S40). For example, when the cleaner operates in the auto mode, the control unit 1800 may change the current value of the suction motor to the calculated corresponding current value (S50). For example, when the cleaner operates in the manual mode, the control unit 1800 may maintain the current value of the suction motor at a value set by the user.

Through the above solution, since the dust sensor is mounted in the suction pipe close to the main body, the present disclosure has an advantage of mounting the dust sensor easily and at a lowered cost when mounting it in the cleaner.

In addition, the present disclosure has an advantage of improving accuracy of the concentration of dust measured by a dust sensor by mounting the dust sensor at a point (a bending part of the flow path) where a flow rate decreases in a suction flow path of a cleaner.

Furthermore, since the dust sensor is disposed in the suction flow path adjacent to the main body, the present disclosure has an advantage of easily connecting a power supply and a communication line, and reducing the length of an electric wire and the communication line or burying the electric wire and the communication line in a frame form in a main body.

In addition, the present disclosure has an advantage of measuring concentration of dust of the sucked air by a dust sensor near a main body of a cleaner, controlling a suction power of a suction motor by quickly reflecting the measured result, and displaying the concentration of dust.

In addition, since a current amount is adjusted depending on the concentration of dust in the sucked air, the present disclosure has an advantage of reducing energy to be used and extending a battery usage time.

In addition, since the dust sensor is disposed farther from the main body than the flap door, the present disclosure has an advantage of improving the reliability of the dust sensor without damage to the dust sensor in the operation of the flat door.

In addition, since the cover of the dust sensor includes the window transmitting light used by the dust sensor and the accommodation part preventing light leakage, the present disclosure has an advantage of measuring the concentration of dust without the dust sensor being exposed into the suction flow path, extending the life of the dust sensor, and improving the accuracy of the dust sensor.

In the above, it will be apparent that, although the preferred embodiments of the present disclosure have been illustrated and described above, the present disclosure is not limited to the above-described specific embodiments, and various modifications can be made by those skilled in the art without departing from the gist of the present disclosure as claimed in the appended claims. The modifications should not be understood separately from the technical spirit or prospect of the present disclosure.

What is claimed is:

1. A cleaner comprising:

a suction flow path configured to receive air from an outside of the cleaner;

a dust separation unit configured to receive the air through the suction flow path and to separate dust in the air;

a fan module configured to move the air in the suction flow path; and a dust sensor configured to measure a concentration of dust in the suction flow path, wherein the suction flow path comprises:

a first suction flow path that extends in a first direction parallel to a horizontal cross-section plane orthogonal to a rotation axis of the fan module, and a second suction flow path that extends in a second direction parallel to the horizontal cross-section plane and connects the first suction flow path to the dust separation unit, the second direction defining an obtuse angle on the horizontal cross-section plane with respect to the first direction, wherein the cleaner further comprises a flap door rotatably disposed in the second suction flow path and configured to open and close the second suction flow path based on an air pressure in the second suction flow path, wherein a central axis of the first suction flow path extends on the horizontal cross-section plane in the first direction and intersects the flap door, wherein the second suction flow path on the horizontal cross-section plane is defined between a first surface of the flap door and a second surface of the cleaner that does not intersect the central axis of the first suction flow path, wherein the dust sensor is disposed along the first surface in the second suction flow path, and wherein the dust sensor is disposed closer to the first suction flow path than to the flap door.

2. The cleaner of claim 1, wherein the dust sensor comprises:

an emitter configured to emit light; and a receiver configured to receive the light emitted from the emitter.

3. The cleaner of claim 2, wherein the dust sensor further comprises a substrate that supports at least one of the emitter or the receiver.

4. The cleaner of claim 2, wherein the emitter and the receiver are disposed in the second suction flow path and face each other across the second suction flow path.

5. The cleaner of claim 4, further comprising a suction pipe that define the second suction flow path, wherein the emitter is disposed at a first side of the suction pipe, and the receiver is disposed at a second end of the suction pipe facing the first side.

6. The cleaner of claim 2, wherein the emitter and the receiver are disposed in the second suction flow path and face a same direction.

7. The cleaner of claim 6, further comprising a suction pipe that define the second suction flow path, wherein the emitter and the receiver are disposed on one side of the suction pipe and arranged adjacent to each other.

8. The cleaner of claim 2, wherein the emitter and the receiver are disposed on one substrate.

9. The cleaner of claim 1, further comprising a sensor cover that covers the dust sensor.

10. The cleaner of claim 9, further comprising a suction pipe that defines the second suction flow path, wherein the sensor cover defines a portion of the suction pipe.

11. The cleaner of claim 9, wherein the dust sensor comprises:

an emitter configured to emit light; and a receiver configured to receive the light emitted from the emitter, and wherein the sensor cover comprises:

an accommodation part that defines an opening configured to receive at least one of the emitter or the receiver, and a window that covers the opening defined at the accommodation part, the window being configured to transmit light.

12. The cleaner of claim 11, wherein the accommodation part includes an impermeable material.

13. The cleaner of claim 11, wherein the sensor cover further includes a cover support that is connected to the accommodation part and extends outward from the accommodation part.

14. The cleaner of claim 13, further comprising a suction pipe that defines the second suction flow path, wherein the cover support is coupled to the suction pipe.

15. The cleaner of claim 13, further comprising a suction pipe that defines the second suction flow path, wherein the cover support contacts the suction pipe.

16. The cleaner of claim 13, further comprising:

a suction pipe that defines the second suction flow path; and a substrate that supports at least one of the emitter or the receiver, wherein the cover support comprises a first surface that contacts the suction pipe, and a second surface that contacts the substrate.

17. The cleaner of claim 11, further comprising a suction pipe that defines the second suction flow path, the suction pipe defining a sensor hole that receives the accommodation part.

18. The cleaner of claim 1, wherein an extension line of the first suction flow path intersects the rotation axis of the fan module.

19. The cleaner of claim 1, wherein the fan module comprises an impeller and a suction motor configured to rotate the impeller about the rotation axis.

* * * * *